US011549512B2

(12) United States Patent
Sarkar et al.

(10) Patent No.: US 11,549,512 B2
(45) Date of Patent: Jan. 10, 2023

(54) MULTISTAGE PUMP WITH AXIAL THRUST OPTIMIZATION

(71) Applicant: KSB SE & Co. KGaA, Frankenthal (DE)

(72) Inventors: Goutam Sarkar, Pune (IN); Kiran Jayantilal Oswal, Pune (IN); Shruti Loveena Damodaran, Pune (IN)

(73) Assignee: KSB SE & Co. KGaA, Frankenthal (DE)

( * ) Notice: Subject to any disclaimer, the term of this patent is extended or adjusted under 35 U.S.C. 154(b) by 0 days.

(21) Appl. No.: 17/280,515

(22) PCT Filed: Sep. 26, 2019

(86) PCT No.: PCT/IN2019/050705
§ 371 (c)(1),
(2) Date: Mar. 26, 2021

(87) PCT Pub. No.: WO2020/065674
PCT Pub. Date: Apr. 2, 2020

(65) Prior Publication Data

US 2022/0042513 A1 Feb. 10, 2022

(30) Foreign Application Priority Data

Sep. 27, 2018 (IN) ..... 201821036447

(51) Int. Cl.
*F04D 15/00* (2006.01)
*F04D 1/06* (2006.01)
(Continued)

(52) U.S. Cl.
CPC ..... *F04D 15/0022* (2013.01); *F04D 1/06* (2013.01); *F04D 15/0011* (2013.01);
(Continued)

(58) Field of Classification Search
CPC .... F04D 15/0022; F04D 15/0011; F04D 1/06; F04D 29/041
See application file for complete search history.

(56) References Cited

U.S. PATENT DOCUMENTS 971,851 A 10/1910 Krogh
4,740,137 A * 4/1988 Karassik ..... F04D 15/0011 415/58.4

(Continued)

FOREIGN PATENT DOCUMENTS

DE 933 849 C 10/1955
EP 0 224 764 A1 6/1987

(Continued)

OTHER PUBLICATIONS

International Search Report (PCT/ISA/210) issued in PCT Application No. PCT/IN2019/050705 dated Dec. 20, 2019 (three (3) pages).

(Continued)

*Primary Examiner* — Topaz L. Elliott
*Assistant Examiner* — Jackson N Gillenwaters
(74) *Attorney, Agent, or Firm* — Crowell & Moring LLP

(57) ABSTRACT

A multistage pump with axial thrust optimization is disclosed includes a pump discharge nozzle and a bypass system coupled to the pump discharge nozzle. The bypass system includes a throttle valve operatively coupled to the pump discharge nozzle, and a bypass line provided at the multistage pump. The bypass line is conducts flow from the throttle valve to a clearance gap of an axial thrust balancing arrangement. The throttle valve may be actuated to adjust a balancing flow through the bypass line such that pressure at the clearance gap is adjusted to increase and decrease fluid pressure at the clearance gap to balance axial thrust at different operating states of the multistage pump.

11 Claims, 5 Drawing Sheets

(51) Int. Cl.
*F04D 29/66* (2006.01)
*F04D 29/041* (2006.01)

(52) U.S. Cl.
CPC ..... *F04D 15/0033* (2013.01); *F04D 29/669* (2013.01); *F04D 29/0416* (2013.01)

(56) References Cited

U.S. PATENT DOCUMENTS

| | | | | |
|---|---|---|---|---|
| 4,892,459 | A | 1/1990 | Guelich | |
| 5,591,016 | A * | 1/1997 | Kubota | F04D 29/061 417/370 |
| 6,129,507 | A | 10/2000 | Ganelin | |
| 7,198,457 | B2 * | 4/2007 | Chiba | F04D 1/063 415/198.1 |
| 8,016,545 | B2 | 9/2011 | Oklejas, Jr. | |
| 2005/0142001 | A1 | 6/2005 | Cornell | |
| 2009/0004032 | A1 * | 1/2009 | Kaupert | F01D 15/005 417/365 |

FOREIGN PATENT DOCUMENTS

| | | | | |
|---|---|---|---|---|
| GB | 5848 | | | 7/1910 |
| GB | 16373 | | | 7/1910 |
| GB | 001183581 | A | * | 3/1967 |
| GB | 1 211 243 | A | | 11/1970 |
| JP | 58-10195 | A | | 1/1983 |
| JP | S5810195 | A | * | 1/1983 |
| WO | WO 2012/166904 | A2 | | 12/2012 |

OTHER PUBLICATIONS

Written Opinion (PCT/ISA/237) issued in PCT Application No. PCT/IN2019/050705 dated Dec. 20, 2019 (seven (7) pages).

Hindi-language Search Report issued in Indian Application No. 201821036447 dated Jun. 8, 2020 with English translation (six (6) pages).

* cited by examiner

MULTISTAGE PUMP WITH AXIAL THRUST OPTIMIZATION

CROSS REFERENCE TO RELATED APPLICATIONS

This application is a national phase of PCT International Application No. PCT/IN2019/050705, Sep. 26, 2019, which claims priority under 35 U.S.C. § 119 from Indian Patent Application No. IN 201821036447, filed Sep. 27, 2018, the entire disclosures of which are herein expressly incorporated by reference.

The present subject matter described herein, relates to pumps, and, more specifically, to axial thrust compensation within multistage centrifugal pumps.

BACKGROUND AND PRIOR ART

Axial thrust is the resultant force of all the axial forces (F) acting on the pump rotor. Axial forces acting on the rotor in the case of a single-stage centrifugal pump includes: The axial impeller force which is the difference between the axial forces on the discharge-side and suction-side impeller shroud; Momentum force which constantly acts on the fluid contained in a defined space; resultant pressure forces arising from the static pressures up and downstream of the shaft seal on the relevant shaft cross-section; Special axial forces, e.g. when changes to the vortex conditions in the clearances between impeller and casing (side gaps) occur during the start-up process; Other axial forces such as the force of the rotor weight on non-horizontal centrifugal pumps or magnetic pull in the electric motor, e.g. in close-coupled pumps.

In the case of multistage pumps with diffusers (e.g. boiler feed pumps), the axial impeller force is largely determined by the impeller's axial position in relation to the diffuser. The rotation of the fluid handled in the discharge-side and suction-side clearances between impeller and casing exerts a strong influence on the axial pressure forces. The mean angular velocity (see Rotational speed) of the rotating fluid handled reaches approx. half the impeller speed. In addition, as a result of Coriolis accelerations, the inward directed clearance flow in the suction-side (i.e. outer) clearance between impeller and casing (side gap) further increases the side gap turbulences. In the discharge-side (i.e. inner) side gap of multistage pumps whose impellers are not hydraulically balanced, the process is reversed as a result of the outward-directed gap flow. The vortex motion is decelerated resulting in an increase of the axial force, and hence of axial impeller force.

Various forms of axial thrust balancing includes: Mechanical: wherein complete absorption of the axial thrust via a thrust bearing (e. g. tilting pad bearing, rolling element bearing); Design-based: back-to-back arrangement of the impellers or stages (see Back-to-back impeller pump); Balancing or reduction of the axial thrust on the individual impeller via balancing holes; Balancing of the complete rotating assembly via a balancing device with automatic balancing (e.g. balance disc and balance disc seat) or partial balancing via a balance drum and double drum; Reduction at the individual impeller by back vanes.

Normally, a multistage pump is equipped with balancing piston to balance the axial thrust developed by impellers. The residual thrust is taken by the thrust bearings. The residual axial thrust is minimum at BEP flow and maximum at minimum flow condition. This restricts the use of antifriction bearing for multistage pumps due to excessive heat generation at minimum flow condition. Therefore, for higher pressure & high-speed applications, forced oil lubricated tilting pad bearings are used. However, the cost of tilting pad bearings and corresponding lube oil plant is very high when compared with antifriction bearings with sump oil lubrication.

OBJECTS OF THE INVENTION

The principal objective of the present invention is to provide a bypass system to reduce the residual axial thrust at part load condition for multistage pumps.

Another object of the present subject matter is to allow use of antifriction bearings for higher pressure applications in multistage pumps.

Another object of the present subject matter is to reduce the size of tilting pad thrust bearing and the corresponding lube oil pump/plant for pumps with forced oil lubricated bearings.

Another object of the present subject matter is to provide a simple, cost effective, and efficiently designed bypass system for multistage pumps that is distinct from all conventional designs.

SUMMARY OF THE INVENTION

The present invention, in an embodiment, relates to a multistage pump (100) with axial thrust optimization. The multistage pump (100) includes a pump discharge nozzle (101); and a bypass system (102) coupled to the pump discharge nozzle (101). The bypass system (102) includes a throttle valve (104) operatively coupled to the pump discharge nozzle (101), and a bypass line (106) provided within the multistage pump (100), the bypass line (106) being coupled to the throttle valve (104) and a clearance gap ("Se"), wherein the clearance gap ("Se") is configured to receive a balancing flow through the bypass line (106) for increasing a pressure in the clearance gap ("Se") for axial thrust optimization.

The present invention, in another embodiment, relates to a multistage pump (500) with axial thrust optimization. The multistage pump (500) includes a bypass system (502) configured for the axial thrust optimization. The bypass system (502) includes a throttle bush (504) provided proximally to a clearance gap ("Se"), wherein the throttle bush (504) defines a bypass line (506), such that the clearance gap ("Se") is configured to receive a balancing flow through the bypass line (506) for increasing a pressure in the clearance gap ("Se") for axial thrust optimization.

In order to further understand the characteristics and technical contents of the present subject matter, a description relating thereto will be made with reference to the accompanying drawings. However, the drawings are illustrative only but not used to limit scope of the present subject matter.

BRIEF DESCRIPTION OF THE DRAWINGS

It is to be noted, however, that the appended drawings illustrate only typical embodiments of the present subject matter and are therefore not to be considered for limiting of its scope, for the invention may admit to other equally effective embodiments. The detailed description is described with reference to the accompanying figures. In the figures, the left-most digit(s) of a reference number identifies the figure in which the reference number first appears. The same numbers are used throughout the figures to reference like features and components. Some embodiments of system or methods in accordance with embodiments of the present subject matter are now described, by way of example, and with reference to the accompanying figures, in which.

Figure 1:
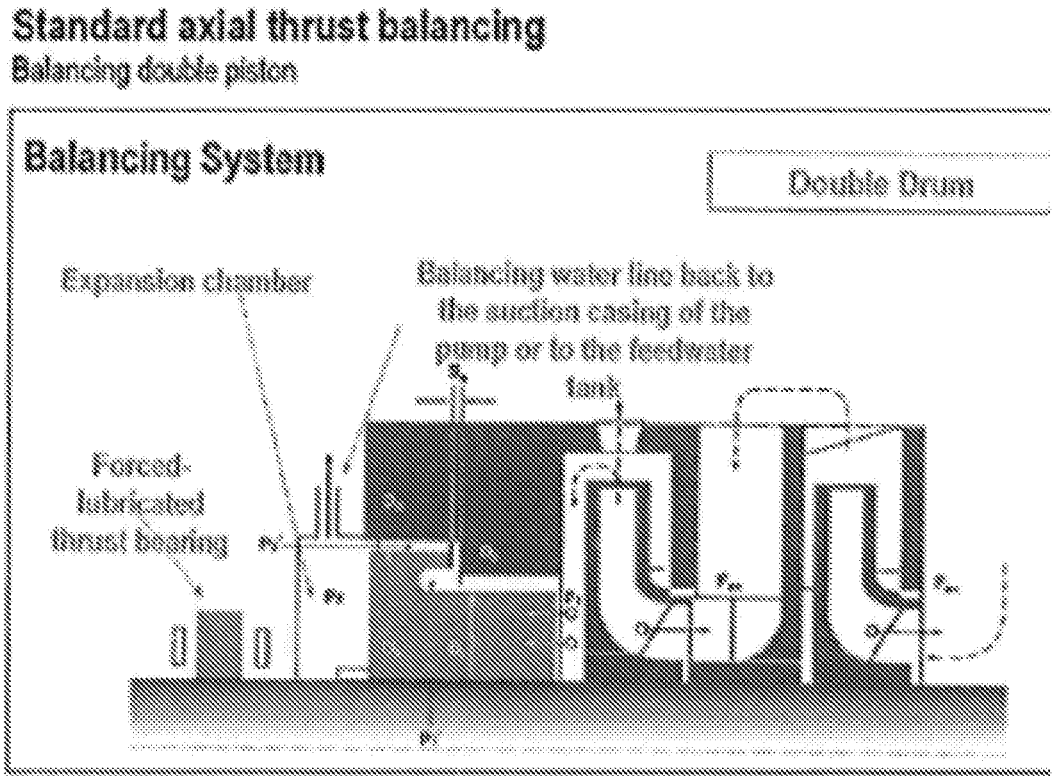
FIG. 1 illustrate a standard axial thrust balancing system.

The figures depict embodiments of the present subject matter for the purposes of illustration only. A person skilled in the art will easily recognize from the following description that alternative embodiments of the structures and methods illustrated herein may be employed without departing from the principles of the disclosure described herein.

DESCRIPTION OF THE PREFERRED EMBODIMENTS

The present disclosure presents embodiments for a multistage pump (100, 500) with axial thrust optimization.

In an embodiment, a multistage pump (100) with axial thrust optimization. The multistage pump (100) includes a pump discharge nozzle (101); and a bypass system (102) coupled to the pump discharge nozzle (101). The bypass system (102) includes a throttle valve (104) operatively coupled to the pump discharge nozzle (101), and a bypass line (106) provided within the multistage pump (100), the bypass line (106) being coupled to the throttle valve (104) and a clearance gap ("Se"), wherein the clearance gap ("Se") is configured to receive a balancing flow through the bypass line (106) for increasing a pressure in the clearance gap ("Se") for axial thrust optimization.

In another embodiment, a multistage pump (500) with axial thrust optimization. The multistage pump (500) includes a bypass system (502) configured for the axial thrust optimization. The bypass system (502) includes a throttle bush (504) provided proximally to a clearance gap ("Se"), wherein the throttle bush (504) defines a bypass line (506), such that the clearance gap ("Se") is configured to receive a balancing flow through the bypass line (506) for increasing a pressure in the clearance gap ("Se") for axial thrust optimization.

It should be noted that the description and figures merely illustrate the principles of the present subject matter. It should be appreciated by those skilled in the art that conception and specific embodiment disclosed may be readily utilized as a basis for modifying or designing other structures for carrying out the same purposes of the present subject matter. It should also be appreciated by those skilled in the art that by devising various arrangements that, although not explicitly described or shown herein, embody the principles of the present subject matter and are included within its spirit and scope. Furthermore, all examples recited herein are principally intended expressly to be for pedagogical purposes to aid the reader in understanding the principles of the present subject matter and the concepts contributed by the inventor(s) to furthering the art and are to be construed as being without limitation to such specifically recited examples and conditions. The novel features which are believed to be characteristic of the present subject matter, both as to its organization and method of operation, together with further objects and advantages will be better understood from the following description when considered in connection with the accompanying figures.

These and other advantages of the present subject matter would be described in greater detail with reference to the following figures. It should be noted that the description merely illustrates the principles of the present subject matter. It will thus be appreciated that those skilled in the art will be able to devise various arrangements that, although not explicitly described herein, embody the principles of the present subject matter and are included within its scope.

Centrifugal pumps are based on the working principle of transferring energy to a fluid by altering its angular momentum by means of a torque which is transmitted from an evenly rotating impeller to the fluid flowing through it. A centrifugal pump can be described as driven machinery considering the direction of energy flow, turbo machinery considering the nature of energy conversion, or hydraulic turbomachinery considering the nature of the fluid. Centrifugal pumps are able to continuously pump high flow rates at high and very high pressure. For high flow rates centrifugal pumps are clearly more cost-effective and reliable than positive displacement pumps.

Examples of centrifugal pumps are axial flow pumps, mixed flow pumps, radial flow pumps and side channel pumps. Further, the centrifugal pumps may be of single stage or multistage and are provided with bearings. The bearing is an element frequently used in centrifugal pump construction that allows a moving component to slide within a stationary component. Further, the bearings may be one of a radial plain bearing or an axial thrust bearing. On radial plain bearings, the moving part is the pin or journal of the axle or shaft; the stationary part is the bearing shell and moving part of an axial (thrust) plain bearing is the thrust collar or plate. Depending on the design, the axial (thrust) plain bearings are subdivided into hydrodynamic, hydrostatic and combined hydrostatic-hydrodynamic plain bearings for special applications. Both basic design types must allow sufficient axial shaft movement to accommodate the lubricant film thickness, which varies according to load, viscosity of the lubricant, and sliding velocity All rotors are supported on bearings which are located in a bearing housing. Forces seen by a rotor are transmitted through the bearings to the bearing housing, then to the structure on which the bearing housing is mounted or connected. The bearings are subjected to forces acting in both radial and/or axial direction relative to the axis of rotation. Bearings are either of antifriction type or of plain bearing type. Antifriction bearing systems are self-contained simpler units with reduced load carrying capacity at higher speeds compared to plain bearings (The term load is used to represent the forces transmitted through a bearing). Plain bearings, as described earlier, require external lubricating oil system. While, antifriction bearing works without such an external lubricating system.

The axial thrust developed in multistage pump is normally minimum at best efficiency point (BEP) and maximum at part load (minimum flow) condition. The magnitude of axial thrust in high speed centrifugal pumps limits the use of antifriction bearings. Generally, multistage centrifugal pumps are provided with a balancing device. The balancing device on centrifugal pumps is designed to fully or partially compensate axial thrust generated by the pump rotor. Designs incorporating a single balance drum or double drum require a thrust bearing to absorb the residual axial thrust.

When the centrifugal pump is in operation, the balancing device requires a certain amount of balancing flow through the clearance gap between the balancing device's rotating and non-rotating parts. The balance flow is subjected to considerable throttling on its way through the gap. This pressure loss results in an axial force acting upon the balancing device which counteracts the impeller's axial thrust and effects the required balancing. Balancing devices are used when the axial thrust involved is extremely high, as is the case with super-pressure pumps.

Figure 2:
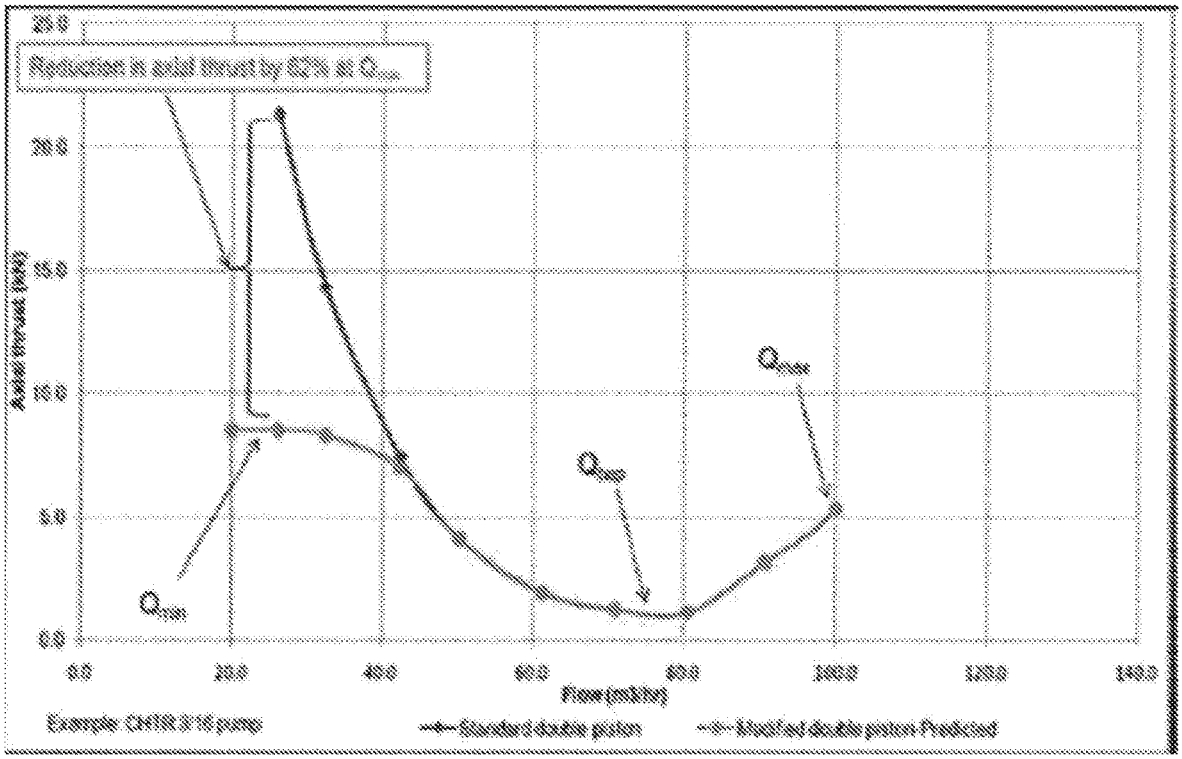
FIG. 2 illustrate unbalanced axial thrust at different flow rate.

FIG. 1 illustrate a standard axial thrust balancing system comprising of a balancing double piston. The pressure drop at various location in the balancing piston is indicated in FIG. 1. About 90% of the impeller thrust load is balanced by the balancing piston while remaining 10% load is accommodated by the thrust bearings. The balancing piston is provided with a balancing flow. The balancing flow is the volume flow required to operate the balancing device of a centrifugal pump. Although it increases the clearance gap losses, it still constitutes an efficient and cost-saving design for axial thrust balancing. Due to the fixed diameter of the balancing piston, it can be designed for only one operating point. The impeller axial thrust is minimum at best efficiency point (BEP) while it is maximum at part load (minimum flow condition). The nature of unbalanced axial thrust at different flow rate is indicated in FIG. 2.

Figure 3:
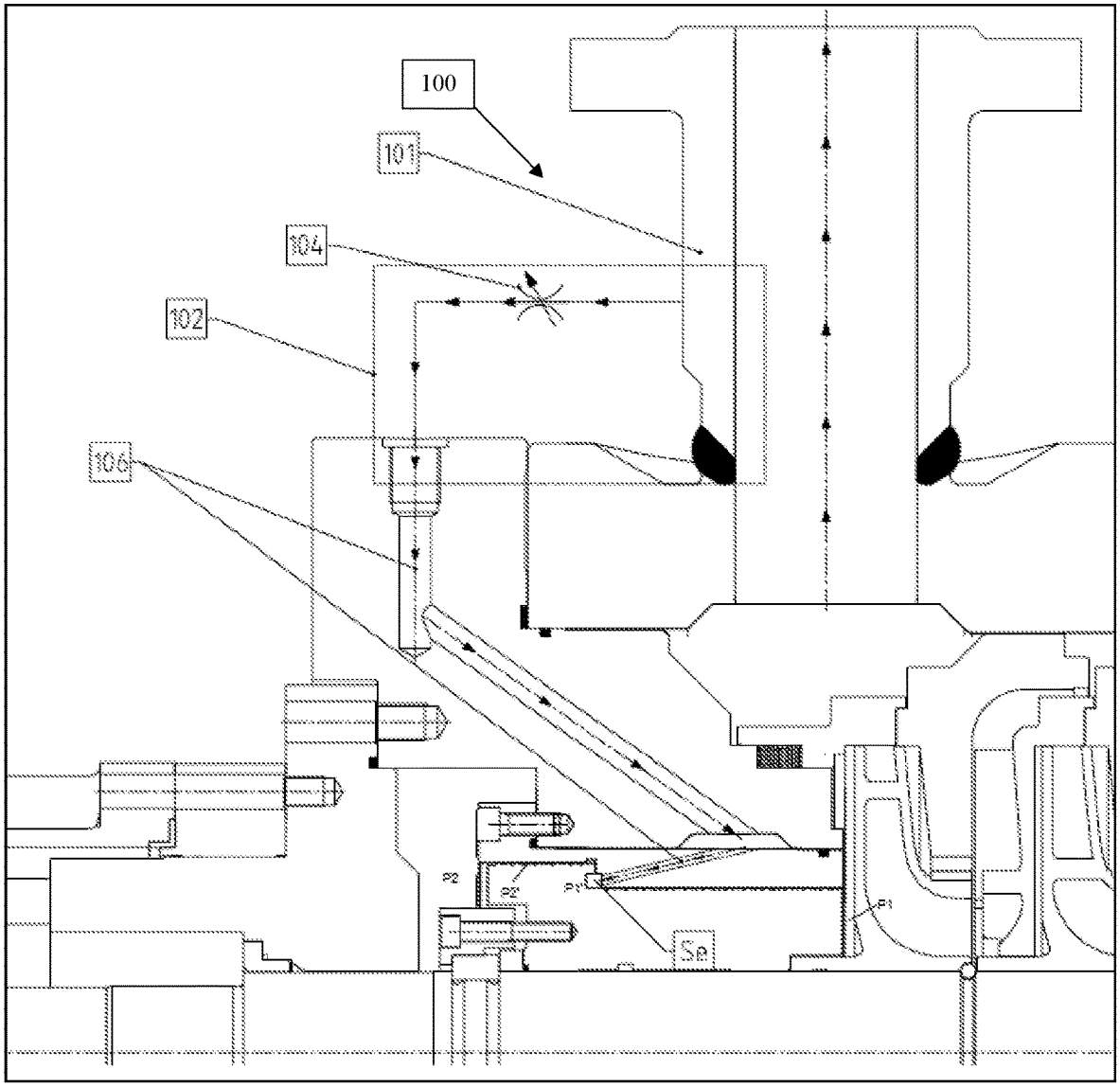
FIG. 3 illustrates a schematic view of a multistage pump (100) with axial thrust optimization in accordance with an embodiment of the present disclosure.

FIG. 3 illustrates a schematic view of a multistage pump (100) with axial thrust optimization in accordance with an embodiment of the present disclosure. In an embodiment, the multistage pump (100) is provided with a bypass system (102) for optimizing the axial thrust. The term bypass means to circumvent or bridge. In centrifugal pump technology, it refers to a line that plays a key role in closed-loop control or as a balancing device. In the context of closed-loop control, it is possible to operate a centrifugal pump with a higher flow rate than that which is usable in the piping.

To this end, a bypass flow is branched off, which can either be routed back to the pump suction nozzle directly from a pump discharge nozzle (101) through a narrow loop or reintegrated with the suction-side flow (after a delay) via different equipment such as a condenser and cooling unit. When acting as a balancing device, the bypass is used to compensate axial thrust in boiler feed pumps.

There are various reasons to integrate the bypass system (102) with the multistage pump (100). Firstly, to stop further operation of the pump in the low-flow range. Secondly, for pumps whose pump input power curve slopes downward for high flow rates (e.g. propeller pumps, peripheral pumps). And lastly, to prevent the fluid handled from heating up in the low-flow range. The bypass flow is branched off via an automatic recirculation valve that is fitted to the discharge nozzle, usually of high-pressure and super-pressure pumps (e. g. boiler feed pumps).

In accordance with embodiments of the present disclosure, the bypass system (102) is configured to increase pressure Pl' (Refer FIGS. 3 and 5) at only minimum flow condition and thereby reduce the unbalanced axial thrust acting on the multistage pump (100). Further, the bypass system (102) is configured to remain inactive at rated/BEP flow.

In an embodiment, as shown in FIG. 3, the bypass system (102) coupled to the pump discharge nozzle (101) includes a throttle valve (104) operatively coupled to the pump discharge nozzle (101), and a bypass line (106) provided within the multistage pump (100), the bypass line (106) being coupled to the throttle valve (104) and a clearance gap ("Se"), wherein the clearance gap ("Se") is configured to receive a balancing flow through the bypass line (106) for increasing a pressure Pl' in the clearance gap ("Se") for axial thrust optimization.

In an embodiment, the throttle valve (104) may be actuated manually; automatically; or semi-automatically. Further, the throttle valve (104) is operated at desired part load flow and the pressure Pl' in the clearance gap ("Se") is increased to a pre-determined calculated value which leads to reduction in residual axial thrust.

Figure 4:
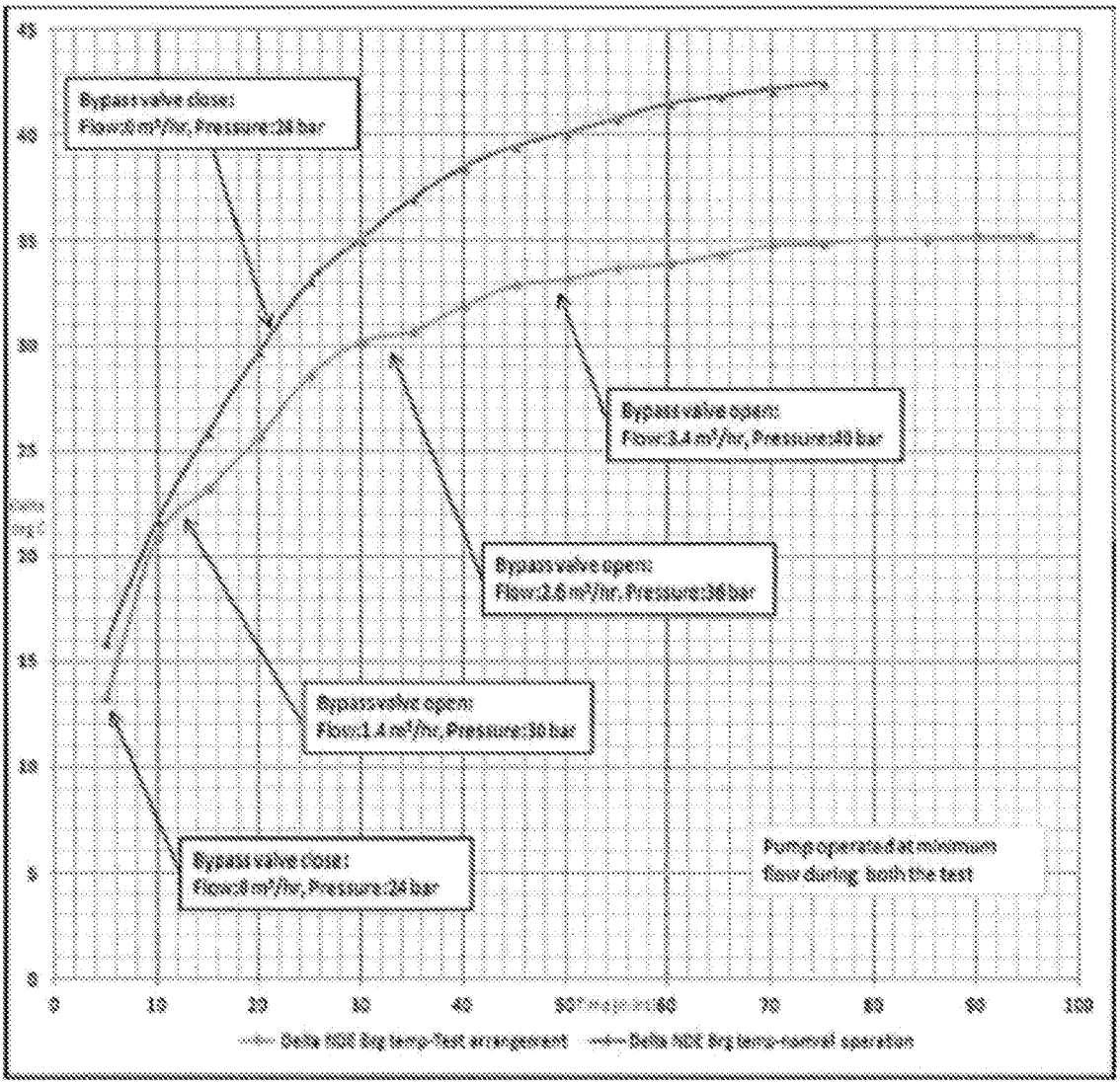
FIG. 4 illustrates graphical results associated with the multistage pump (100) of FIG. 3.

FIG. 4 illustrates graphical results associated with the multistage pump (100). In an example, the graphical results include a plot of bearing temperature vs time for the multistage pump (100). In an example, the multistage pump (100) is a CHTR 4/1+6 pump (a centrifugal, high-pressure, multistage barrel pump) with antifriction bearings. In an example, the pressure Pl' in the clearance gap ("Se") is about 24 bars at minimum flow of about 60 m^3/hr. In another example, the throttle valve (104) in the bypass line (106) is operated in steps until the pressure Pl' in the clearance gap ("Se") is increased to a pre-determined calculated value of 40 bar. It is evident from FIG. 4, that the bearing temperature is reduced by 7 degrees Celsius, which indicates that the axial load on the bearing of the multistage pump (100) is reduced.

Figure 5:
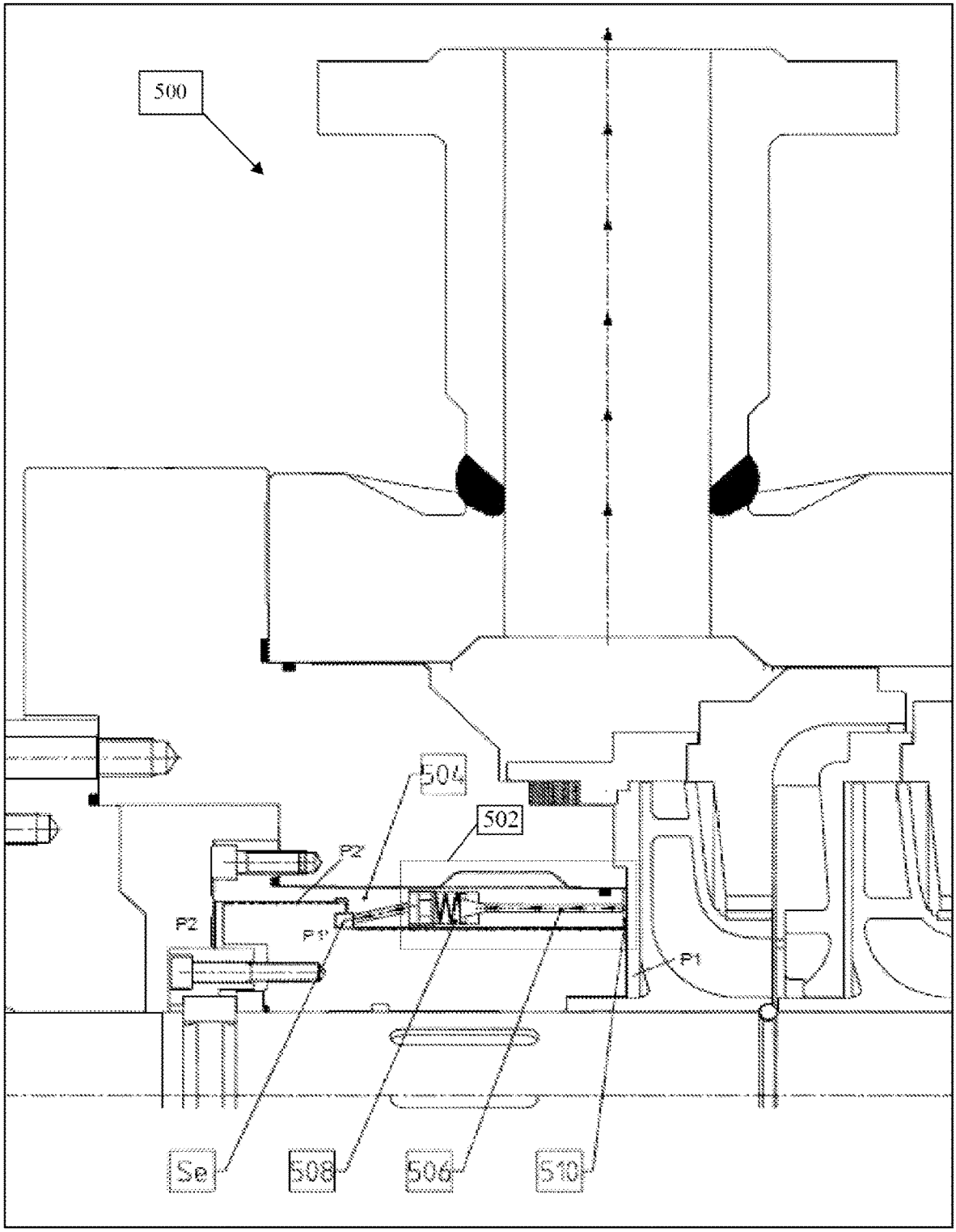
FIG. 5 illustrates a schematic view of a multistage pump (500) with axial thrust optimization in accordance with another embodiment of the present disclosure.

FIG. 5 illustrates a schematic view of a multistage pump (500) with axial thrust optimization in accordance with another embodiment of the present disclosure. In another embodiment, the multistage pump (500) includes a bypass system (502) configured for the axial thrust optimization. In another embodiment, the bypass system (502) includes a throttle bush (504) provided proximally to a clearance gap ("Se"), wherein the throttle bush (504) defines a bypass line (506), such that the clearance gap ("Se") is configured to receive a balancing flow through the bypass line (5 06) for increasing a pressure Pl' in the clearance gap ("Se") for axial thrust optimization.

In another embodiment, the throttle bush (504) includes a flow control device (508) disposed at one end of the bypass line (506) proximal to the clearance gap ("Se"), and an orifice plate (510) disposed at another end of the bypass line (506) opposite to the flow control device (508). In an example, the flow control device (508) is spring loaded and is configured to operate at part load conditions. In operation, the flow control device (508) operates at the pre-determined calculated value of the pressure Pl', and the flow control device (508) does not operates when the multistage pump (500) is operated at best efficiency/rated flow. Further in another embodiment, the orifice plate (510) is configured to decrease discharge pressure and increase the pressure Pl' in the clearance gap ("Se") to a pre-determined calculated value.

The bypass system (102, 502) allows the multistage pump (100, 500) to employ antifriction bearings instead of forced oil lubricated tilting pad bearings, thereby providing a cost-effective solution. Further, overall length of the multistage pump (100, 500) and bearing span is reduced. Further, elimination of costly lube oil plant, corresponding piping and accessories is achieved.

In certain cases, it is desired that the pump be equipped with forced oil lubricated plain bearings and tilting pad thrust bearings. Here, considerable reduction in the size of tilting pad thrust bearing and lube oil pump/plant may be achieved by using the bypass system (102, 502), as the net thrust load acting on tilting pad bearing is reduced.

Although embodiments for the present subject matter have been described in language specific to structural features, it is to be understood that the present subject matter is not necessarily limited to the specific features described. Rather, the specific features and methods are disclosed as embodiments for the present subject matter. Numerous modifications and adaptations of the system/component of the present invention will be apparent to those skilled in the art, and thus it is intended by the appended claims to cover all such modifications and adaptations which fall within the scope of the present subject matter.

We claim:

1. A multistage pump with axial thrust adjustment, comprising:

a pump discharge nozzle; and a bypass system coupled to the pump discharge nozzle, the bypass system including:

a bypass line of the multistage pump, and a throttle valve operatively coupled to the pump discharge nozzle, the throttle valve being configured to adjust a balancing flow through the bypass line, and wherein a clearance gap provided for balancing axial thrust in the multistage pump is configured to receive the balancing flow through the bypass line, the throttle valve is actuatable to adjust fluid pressure in the clearance gap to control an amount of axial thrust balancing as a function of an operating state of the multistage pump, and the multi-stage pump is configured to operate the throttle valve in the bypass line in predetermined steps.

2. The multistage pump as claimed in claim 1, wherein the throttle valve is one or more of manually, automatically, semi-automatically actuatable.

3. The multistage pump as claimed in claim 1, wherein the throttle valve is actuatable to control the balancing flow operated such that the fluid pressure in the clearance gap is adjusted to a predetermined value based on the multistage pump operating state to reduce residual axial thrust.

4. The multistage pump as claimed in claim 1, wherein the multistage pump is a centrifugal, high pressure barrel pump with antifriction bearings.

5. The multistage pump as claimed in claim 1, wherein the pressure in the clearance gap is 24 bar at a pump minimum flow of 60 $m^3$/hr.

6. The multistage pump as claimed in claim 1, wherein the throttle valve in the bypass line is operable in the predetermined steps until the pressure in the clearance gap is increased to 40 bar.

7. A multistage pump with axial thrust adjustment, comprising:

a bypass system configured for axial thrust adjustment, the bypass system including:

a throttle bush proximal to a clearance gap of an axial thrust balancing arrangement, the throttle bush including a bypass line, wherein the clearance gap is configured to receive a balancing flow through the bypass line to control an amount of axial thrust balancing as a function of an operating state of the multistage pump, the flow control device is configured to actuate at the predetermined pressure value, and the flow control device is configured to not actuate when the multistage pump is operated at a best efficiency flow rate such that there is no flow from an impeller side of the bypass system through the clearance gap.

8. The multistage pump as claimed in claim 7, wherein the throttle bush includes a flow control device disposed at one end of the bypass line proximal to the clearance gap, and an orifice plate disposed at an end of the bypass line opposite to the end at which the flow control device is disposed.

9. The multistage pump as claimed in claim 8, wherein the flow control device is spring loaded.

10. The multistage pump as claimed in claim 8, wherein the flow control device is configured to actuate when the multistage pump is at a part load condition.

11. The multistage pump as claimed in claim 8, wherein the orifice plate is configured to control a fluid pressure at the clearance gap to a predetermined value.

* * * * *